US005287902A

United States Patent [19]

Jeantelot

[11] Patent Number: 5,287,902

[45] Date of Patent: Feb. 22, 1994

[54] METHOD TO SPLIT LOGS INTO QUARTERS AND MACHINE FOR ITS IMPLEMENTATION

[76] Inventor: Maurice Jeantelot, 5, Grande Rue, F-10110 Landreville, France

[21] Appl. No.: 976,937

[22] Filed: Nov. 17, 1992

[30] Foreign Application Priority Data

Nov. 18, 1991 [FR] France ..... 9114165

[51] Int. Cl.[5] ..... B27L 7/00

[52] U.S. Cl. ..... 144/366; 144/3 K; 144/193 R; 144/193 A

[58] Field of Search ..... 144/193 R, 193 A, 366

[56] References Cited

U.S. PATENT DOCUMENTS 4,294,295 10/1981 Olin ..... 144/193 A
4,371,020 2/1983 Barnes et al. ..... 144/193 A
4,869,303 9/1989 Nunnery et al. ..... 144/193 A

*Primary Examiner*—W. Donald Bray
*Attorney, Agent, or Firm*—Rodgers & Rodgers

[57] ABSTRACT

A method of splitting a log, in that the log (B) is squeezed at its ends, but in such a way as to be able to pivot to get the axis of its core, i.e. its longitudinal gravity axis, into a horizontal position by means of sets of two jaws, and then split into four, eight or twelve quarters, along the wood grain and with its medullar rays, under the action of two opposite pairs of splitting tools (10, 13) adapted to be able to rotate when undergoing the thrust of respective control cylinder (12, 15); one pair of tools (10) lies in a nearly vertical plane and acts upon one end of the log for its initial splitting into four, the other pair (13) lying in a nearly horizontal plane and acting upon the other end of the log, the splitting of the latter into eight or twelve quarters being achieved through giving the plane of this pair of tools a chosen inclination, the pairs of tools being always adjusted perpendicularly to one another.

11 Claims, 2 Drawing Sheets

METHOD TO SPLIT LOGS INTO QUARTERS AND MACHINE FOR ITS IMPLEMENTATION

BACKGROUND OF THE INVENTION

The present invention relates to a method of splitting a log with its medullar rays so as to produce quarters that can be converted into thin-cut sections or planks through being split along the wood grain and with its medullar rays. It especially relates to such a splitting method in which the log is held by jaws that can pivot at both its ends, thus getting the axis of its core, i.e. its longitudinal gravity axis, into a horizontal position, and is then split into four, eight or twelve quarters under the action of two opposite pairs of splitting tools that can rotate when undergoing the thrust of control cylinders, whereby one pair of tools lies in a nearly vertical plane and acts upon one end of the log for its initial splitting into four, the other pair lying in a nearly horizontal plane and acting upon the other end of the log, the splitting of the latter into eight or twelve quarters being achieved through giving the plane of this pair of tools a chosen inclination, the pairs of tools being always adjusted perpendicularly to one another.

Besides, the present invention concerns a machine of splitting logs, with the medullar rays of each log in order to produce quarters that can be converted into thin-cut sections while following the wood grain of the log and without breaking or cutting its fibers.

It should be especially noted that this splitting method and this splitting machine are designed, according to the invention, to produce quarters that can be converted into thin-cut sections along the wood grain by using the splitting method and the machine its implementation for which the U.S. Pat. No. 5,090,463 has been accorded.

In the technique currently used to produce quarters from a log, the latter is split into four, six, eight or twelve quarters by means of a splitting tool that acts vertically upon the top end of a log standing upright, so that in order to produce e.g. four halves, it is necessary to first split the log into two quarters and consecutively split each half into two, which raises the number of manipulations or passages through the machine to three and thus considerable increases the working time needed for each single quarter produced. Furthermore it should be noted that in this splitting operation, which is known for its good output and the production of suitable wood quarters, it is necessary to use logs with a nearly rectilinear grain and/or a core approximately located in the central part of both ends of each log. Besides, in most cases, the splitting tool being thrust downwards in a vertical direction by a control cylinder and striking the top end of the log like an axe, it does not act like a splitter between the layers of wood fibers but its effect produces rather a splitering of the log without regard for its grain.

The U.S. Pat. No. 3,974,867 disclosed a machine of splitting logs into four quarters which uses a tool with four fixed blades that are set quadrangularly, the tool acting upon each end of the log and being fixed on a moving bearing plate driven by a double action control cylinder. In this machine, the log is first assisted by means of rest flaps operated by control cylinders, before being squeezed at both ends between central wedges borne by the tools and then split into four quarters through the fixed blades of the two tools that are driven toward one another as a consequence of their bearing plate moving under the action of their respective control cylinder. In this known machine, the blades therefore act rather like wedges that penetrate longitudinally into the fibers, breaking or cutting them; indeed, since they have a radially fixed position, the blades can follow neither the grain of the timber nor its medullar rays and the quarters thus produced are consequently unfit for the conversion of logs into thin-cut woods through splitting.

U.S. Pat. No. 4,805,676 also disclosed a machine to cut up trunks into round timbers and split these round timbers into two, three or six quarters, whereby a thrust is exerted upon their back end to drive them forward until the splitting blades of a device located upstream penetrate into their front end and split it longitudinally. Here again, this splitting device is not adapted to split the log along its grain but, as is the case with the machine disclosed by the above-mentioned U.S. Pat. No. 3,974,867, the blades act like wedges that can break or cut the wood fibers and that are not adapted to follow the wood grain or to take its medullar rays into account because of their radially fixed position.

As a consequence, the method for splitting a log into quarters according to the present invention aims at getting rid of most of the drawbacks arising from the known splitting techniques defined above and making it possible to save time in an appreciable measure and to produce wood quarters that can be converted into thin-cut sections with as little waste as possible for an economic production while producing reliable wood quarters, even when using logs with a kernel that more or less deviates from the central part between its two ends.

On the other hand, this method of splitting a log into quarters and the machine for its implementation are designed to ensure the production of wood quarters along the grain and to bring to its lowest degree the risk of breaking the fibers and/or splitering some of the fibers layers that lie between the kernel and the sapwood.

SUMMARY OF THE INVENTION

According to the present invention, this method of splitting a log into quarters first of all consisting in making a superficial hole into the core of the log at each of its ends, so as to allow the partial introduction of a pin, then in lifting this log in such a manner that both its pins will lie in one horizontal plane and that the protuding part of each pin will rest onto a respective end support; the method wherein the raising force exerted upon the log ceases as soon as the latter is supported by its pins, so that, by pivoting on them under the action of gravity, it will first take a balanced position, whereupon, once it is stabilized in this position, it is clamped between two opposite jaws that act upon each of its ends respectively and that are mounted in such a way as to be able to rotate into squeezing positions, one of them lying in a nearly horizontal plane when at rest; the splitting operation then starts by cutting into both ends of the log by means of a pair of tools set, when at rest, perpendicularly to the rest plane of the jaw leaning against the corresponding end, the pair of tools being adjusted in such a way that it can cross the opposite pair in the median part of the log in the course of each splitting operation each twin tool of each pair is driven by a control cylinder and can reciprocate according to the direction of the wood grain independently from the other. Then the splitting operation is carried on up to the point when each pair of tools has reached the end of the log opposite to its starting point, at which time both pairs of tools are driven back to their initial rest position. Then the jaws are operated to loosen their grip in order to release the wood quarters that will rest in a cradle out of which they will be laterally toppled over onto a device conveying them to the machine that comes next.

This method of splitting a log into four quarters with one single splitting operation is further distinguished that during the splitting operation, when both pairs of tools come within close reach of their crossing point during their splitting course, the two lower quarters are assisted by actuating the lifting up of the cradle until the latter is brought into contact with them, without raising them so as not to act against the pressure exerted by the jaws.

It should be noted that this method of splitting a log into four quarters can be followed by one or several secondary splitting operations realized on the same machine, whereby, according to the invention, eight or twelve quarters be produced from one single log, these twelfths being acknowledged to be the most suitable for the production of thin-cut sections with a minimum waste of wood.

Thus, according to the invention, in order to produce eight quarters, the basic method is first carried out until the log has been split into four quarters and the tools have been driven back to their rest position, at which point, instead of operating the jaws into loosening their grip, each pair of tools is made to rotate in its diametral plane thanks to its two driving control cylinders so that each of its cutting edges will form a 45° radial angle with the plane of the jaws placed at the same end of the log. Then a second splitting operation is started, whereby each of the four quarters previously produced is split into two further quarters. Finally, after the tools have been driven back to their rest position, the jaws are operated into loosening their grip in order to release the eighths produced from the log into the cradle.

Besides, according to the invention, in order to produce twelve quarters, the basic method for the production of four quarters is first carried out like in the previous operation, but instead of operating the jaws into loosening their grip, each pair of tools is made to rotate clockwise in its diametral plane by two driving control cylinders so that each of the cutting edges will form a 60° radial angle with the plane of the corresponding jaws. Then a second splitting operation is started and after the tools have been driven back to their rest position, the jaws are kept in their squeezing position and each pair of tools is made again to rotate in its diametral plane but in the opposite direction, i.e. anti-clockwise, due to its two driving control cylinders so that each of the cutting edges will form a 60° angle with the plane of the corresponding jaws. Then a third splitting operation is started and, after the tools have been driven back to their initial rest position, the jaws are operated to loosen their grip in order to release the twelfths produced from the log into the cradle.

It is easily understandable that in order to split another log into twelfths thereafter, there is no need to rotate the pairs of tools back to the initial position adapted for the splitting into fourths, i.e. to set them at right angle with the plane of the corresponding jaws, but the first splitting operation will be started with these pairs of tools inclined in one direction and forming a 60° angle with the plane of the jaws. Like in the preceding case, the inclination at a right angle is set before the second splitting operation and the inclination at a 60° angle in the opposite direction is set before the third splitting operation.

This splitting method is implemented according to the invention by means of a machine of the type that comprises mobile jaws adapted to grip a log by its longitudinal extremities, as well as splitting tools also placed close to each of these extremities and adapted to split the log into several quarters, the number of which can be chosen between four, eight or twelve, the log being split under the thrust of control cylinders. This machine whose special feature is that it comprises a rigid support chassis, on each longitudinal extremity of which a sliding frame is mounted, the alternate moving of which is controlled by a double action control cylinder for the closing and opening of the jaws. Each sliding frame includes a set of two jaws that are held apart from one another on each side of their central support lying in the axis of the frame. Thus in the longitudinal axis of the support chassis, one of the sets of jaws is mounted in such a manner as to be able to pivot into a vertical plane on one of the frames, whereas the opposite set of jaws is mounted so as to be able to pivot into a horizontal plane on the other sliding frame. Each of these sliding frames also includes a pair or a set of two splitting tools lying in the same plane, along with their respective double action driving control cylinders, each tool being mounted on the rod of its own control cylinder so as to be able to rotate individually during the splitting operation. Both tools of each set on each sliding frame are held apart from one another on each side of the central support of the corresponding set of two jaws and lying, along with their respective control cylinders, in a plane perpendicular to the plane in which the set of jaws is mounted on this sliding frame. Each of the tools of both sets is furthermore set, when at rest, in the same vertical plane or the same horizontal plane in which it is mounted, by means of a guiding cam the action of which ceases when the tool begins to cut into the corresponding end of the log.

Moreover, the central support of each set of jaws is fitted with two bars pivoted on it in their middle and bearing a long bar at each of their extremities. The bars are hinged upon them and forming, together with the bar, a parallelogram-like mounting, each bar bearing one of the jaws of the set of jaws at its free end at a level with the corresponding splitting tools, the jaw being hinged upon the bar but held in a position nearly perpendicular to the axis of its supporting bar by means of an elastic device when at rest.

On the other hand, each central support of a set of jaws is fitted with a tube part that extends out of its extremity near the jaws and undergoes the stress of a spring; the part is adapted to receive the supporting pin set into the core of a log when the latter is loaded to be split.

Besides, as some logs sometimes have a core that more or less deviates from the central part between its two ends, the end faces may display a slant when the log is balanced into a horizontal plane along its gravity axis defined by the pins that are supported by the tube, placed at the same level, the slant possibly adding up with the initial cutting slant, so that the corresponding jaws will not properly fit the end faces if the bars that make up two sides of the parallelogram-like mounting do not have a limited inclination. As a consequence, in order to limit the inclination of the bars in one direction or the other, a stop motion device has been provided on the central support near the back bar, i.e. opposite to the jaws, a device on which the extremities of the back lever can firmly rest.

As was previously stated, this machine, according to the invention, is basically designed to split logs into four quarters but it can also be used to split logs into eight or twelve quarters, provided some adjustments are made between each splitting operation.

To this end, each pair of driving control cylinders of each pair of splitting tools is so designed that it can be rotated into planes forming an angle with their own initial plane which is vertical for one of the pairs and horizontal for the other pair. This is achieved through a front and a back support mounting for each pair of control cylinders respectively, this mounting being adapted to be able to rotate through a maximum angle of 45° (i.e. a eighth), both clockwise and anti-clockwise, around the central support of each set of jaws, starting from the initial position of each pair of control cylinders respectively, one of these pairs lying in a vertical plane and the other lying in a horizontal plane.

Each support mounting is thus adapted to be able to rotate through an angle of 30° in both directions and to be immobilized in each of the resulting positions so as to form a 60° angle with the plane of the corresponding set of jaws in order to allow the splitting into three quarters of each of the four quarters produced during the first splitting operation. Of course, after the splitting of a log into four quarters as was previously described, a 45° rotation of each support mounting and the immobilization of the latter in the resulting position will allow the production of eight quarters through a second splitting operation.

It should be noted that the machine designed to split logs into four, eight or twelve quarters could be realized in a different manner, whereby, while remaining within the framework of the present invention and instead of providing a front and a back support mounting for each pair of control cylinders respectively, the support mounting is adjusted so as to rotate around the central support of each corresponding set of jaws. The parallelogram-like support mounting of these sets of jaws could be made to rotate around their own central support with the same inclination angles as those provided for the pairs of control cylinders, though the latter would accordingly be held in their initial fixed position, respectively vertical and horizontal.

On the other hand, according to the invention, if a log is to be split into four quarters only, both jaws of each set are designed as long straight blocks each fitted with a clamping jaw adapted to be able to slide outwards when the quarters that are being split, the clamping jaws being brought back to their initial position under the stress of a spring when the tools are driven back.

In the same way, according to the invention, for the splitting of logs into eighths or twelfths, the jaws should be able to grip and squeeze a larger surface and are thus designed, as in the preceding case, as long straight blocks, the clamping jaw of which, while being adapted to be able to slide outwards and then be brought back by a spring, is fitted with a transversal support, these two elements building a cross, the transversal support being fitted at both ends with a pad equipped with clamping chucks. The pad may be adjusted, if needed, to slide towards the central clamping jaw by means of a spring while the transversal support is designed in such a way that both its pads, when at rest, are at a maximum 80° angle with one another, the bisecting line of this angle lying in the axis of the clamping jaw.

Besides, in order to assist the log during the splitting operation and for a soft reception of the split quarters, the machine, according to the invention, comprises a cradle with two rest branches, the upward or downward movings of which are independently controlled by means of two distinct control cylinders; still they can be laterally swung together and simultaneously by means of a third control cylinder.

The above-mentioned constitution of the cradle is easily understandable since it meets the need for assisting the log during the splitting operation; indeed, when a log shows a fairly important slant in its lower part after finding its balance along its longitudinal gravity axis defined by its core, it is necessary for one of the rest branches to come into contact with the comparatively lower part without supporting it. The other rest branch will do the same with the comparatively higher part, in order to prevent the quarters that are being split from inadvertently shifting too much downwards, should their extremities unexpectedly slide along the jaws once the first splitting operation has been completed and the supporting pins are of no longer use.

Furthermore, in order to provide a better fastening of the log through the cradle, with the slight play of the log in its balanced position, the two branches of the cradle can be, if necessary, fitted with an elastic pad that will take the exact shape of the corresponding lower contour of the bark of the log, thus supporting it, however without lifting it.

BRIEF DESCRIPTION OF THE DRAWINGS

Further characteristics of the present invention will be provided through the following description of one possible realization of a machine splitting logs into wood quarters, the machine being represented, as an example and in a very schematic way, in the attached drawings where.

DESCRIPTION OF THE PREFERRED EMBODIMENT

Figure 1:
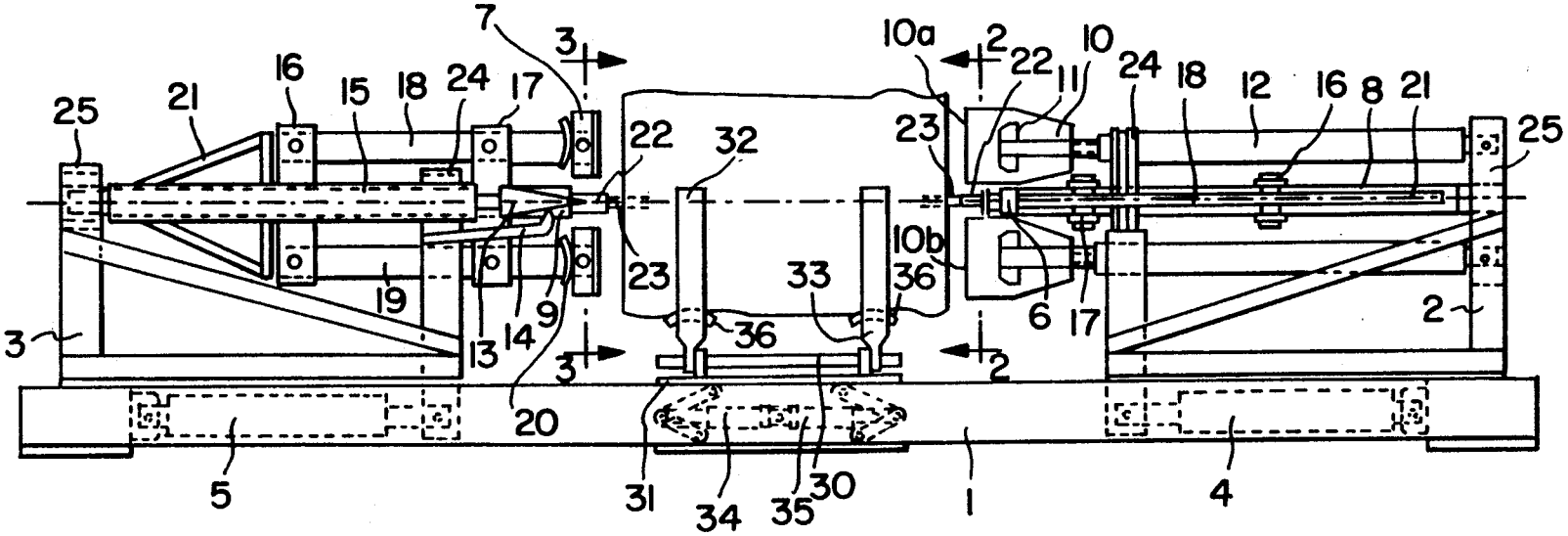
FIG. 1 is a schematic front view of the splitting machine according to the invention.

As shown in FIG. 1, the splitting machine comprises a rigid support chassis (1) bearing sliding frames (2, 3) at its extremities, the alternate moving being controlled respectively by control cylinders (4, 5) represented with dotted lines. Each sliding frame bears a set of two jaws, one set (6) in a horizontal position on the frame (2) and one set (7) in a vertical position on the frame (3). A central support identified by the numeral (8) is mounted on frame (2) and (9) a central support frame (3). The set of jaws (6), borne by the frame (2), is mounted in to be able to reciprocate in a horizontal plane whereas the opposite set (7), borne by the frame (3), is mounted to be able to reciprocate in a vertical plane. The frame (2) also bears a set (10) of two splitting tools adapted to be able to rotate individually during their splitting travel and the cutting edges (10*a*, 10*b*) which are maintained, when at rest, in the same vertical plane by means of a guiding cam (11), along with the two respective driving control cylinders (12) of the set (10) of tools that are set in the same vertical plane for the splitting of a log (B) into four quarters (see FIG. 2). The frame (3) also bears a set (13) of two splitting tools adapted to be able to rotate individually during their splitting travel and the cutting edges (13*a*, 13*b*) which are maintained, when at rest, in the same horizontal plane by means of a guiding cam (14), along with the two respective driving control cylinders (15) of the set (13) of tools that are set in the same horizontal plane for the splitting of the log (B) into four quarters.

Figure 2:
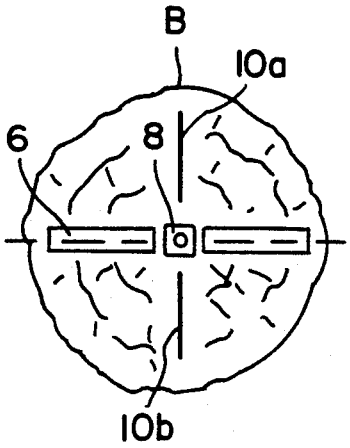
FIG. 2 is a cutaway view along line 2—2 of FIG. 1 in the direction of the arrow heads.
Figure 3:
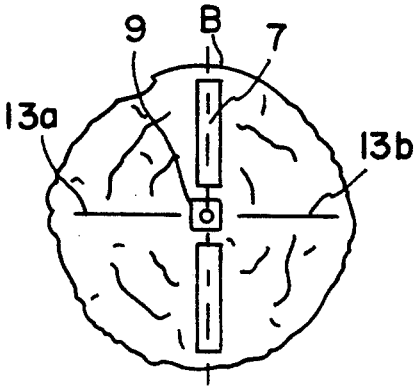
FIG. 3 is a cutaway view along line 3—3 of FIG. 1 in the direction of the arrow heads.

It should be noted that the two splitting tools of each set (10,13) are separated from one another on either side of the respective central support (8, 9), as is better shown in FIGS. 2 and 3, in order to be able to cross the two opposite splitting tools in the course of a splitting operation, during the splitting travel on the one hand, and during the return course to their rest position on the other hand, even if each of these four tools can rotate independently from the others, thus deviating from its initial cutting plan so as to split the wood with its medullar rays.

Moreover, it is to be noted that each set of two jaws is mounted on the corresponding central support (8,9) through a parallelogram-like mounting that is identical for each frame but set in a horizontal position on the frame (2) and in a vertical position on the frame (3). Each mounting is made up of two bars (16, 17) pivoted on the associated central support at the middle and upon the extremities of which long bars (18, 19) are respectively hinged, long bars (18, 19) respectively bearing one of the two jaws of the corresponding set (6, 7), the jaw being hinged upon that free extremity of the bar near the log (B), each jaw being however held, when at rest, perpendicularly to its bar by means of springs (20). In order to prevent the bars (16, 17) that make up two sides of the parallelogram-like mounting from being too much inclined when leaning against the corresponding cut end face of the log (B), a triangular stop motion device (21) has been mounted on the corresponding central support, a device on which the extremities of the back bar (16) can rest.

On the other hand, the free extremity of each respective central support (8,9) near the jaws is fitted with a protuding tube (22) adapted to receive the corresponding supporting pin (23) when the log (B) is put into splitting position. The supporting pin is partially driven into the core of the log in order to determine its balanced position in the machine before the jaws squeeze it, the tube undergoing the stress of a spring and retracting into its support when the jaws move into their squeezing position.

Figure 4:
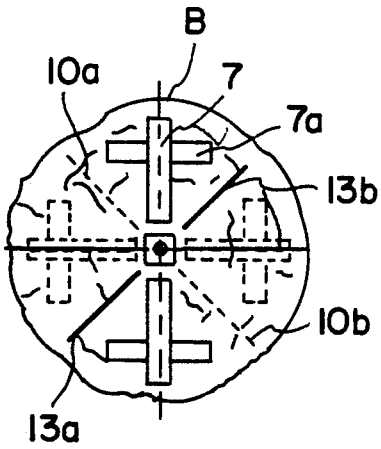
FIG. 4 is a view similar to the one in FIG. 2 but showing different splitting axes with a 45° inclination.

This machine also makes it possible, after a log has been split into four, to produce eight quarters (as shown in FIG. 4) through splitting a log into four quarters twice consecutively, the second operation being realized with each of the two sets of tools being rotated in one direction or the other in its diametral plane through an angle of 45° with the position it had in the first splitting operation, both sets of jaws remaining in their initial squeezing position.

Figure 5:
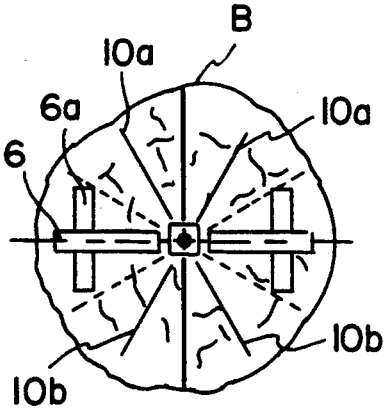
FIG. 5 is a view similar to the one in FIG. 2, in which splitting axes forming a 30° angle on either side of the vertical are shown.
Figure 6:
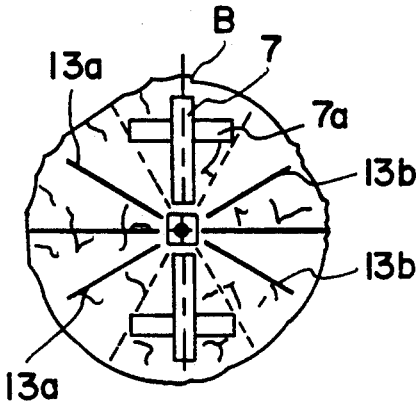
FIG. 6 is a view similar to the one in FIG. 3, in which splitting axes forming a 30° angle on either side of the horizontal are shown.

Furthermore, this machine also makes it possible to split a log into twelve quarters (as shown in FIGS. 5 and 6) through three consecutive splitting operations, i.e. a first splitting into four, followed by a second splitting operation with each of the two sets of tools being rotated in one direction in its diametral plane through an angle of 30° with its position in the first operation; then a third operation with each of the two sets of tools being rotated in the other direction in its diametral plane through an angle of 30° with its position in the first operation, each set of jaws remaining in its initial squeezing position, as in the previous case.

To this end, the front (24) and back (25) support mountings of both driving control cylinders of each set of splitting tools are adjusted in such a way that they can pivot together on the corresponding central support and be immobilized in such positions as to adjust the sets of tools according to the diametral inclination abovementioned.

On the other hand, for a splitting operation into four quarters, the jaws of each set are designed as long straight blocks fitted with a clamping jaw adapted to be able to slide outwards and then be brought back to a rest position by means of a spring (not represented in the figures) when the jaws are opened. Yet, when splitting operations into eight or twelve quarters have to be realized, each clamping jaw can be fitted with a transversal support (6*a*, 7*a*), the two elements building a cross, the transversal support being fitted at both ends with a pad equipped with clamping chucks; the pad can slide outwards and be brought back towards the clamping jaw by means of a spring, while the transversal support is designed in such a way that both its pads, when at rest, are at a maximum 80° angle with one another, the bisecting line of this angle lying in the axis of the clamping jaw.

Besides, this splitting machine also comprises a cradle (30) adapted to assist the log (B) during the splitting operation, to receive the wood quarters with no excessive falling and to release these quarters by toppling them over onto a conveying device. This cradle comprises a bearing plate (31) upon which two rest branches (32, 33) are hinged, the upward and downward moving of which is controlled by two distinct control cylinders (34, 35). These two control cylinders allow the setting of the bearing plate (31) according to a chosen longitudinal inclination, so that the branches resting on it may come into contact with the corresponding lower contour of the log without raising it, after the log has found a balanced position and the jaws are closed. It should be noted that, in order to be elastic enough to take the exact shapes of the lower contours of the log that rests perpendicularly to each rest branch of the cradle, the branch can be fitted with an elastic pad (36).

I claim:

1. A method of splitting a log with its medullar rays so as to produce quarters that can be subsequently converted into thin-cut sections comprising the steps of making a superficial hole in the core of the log at each of its ends so as to allow the partial introduction of pins (23) therein, lifting the log in such a manner that both pins will lie in a horizontal plane, resting the protruding part of each pin onto respective end supports, raising the log until it is supported by said pins, allowing the log to pivot on said pins so as to take a balanced position, clamping the log between two opposite jaws (6,7), one of said jaws (7) lying in a substantially horizontal plane when at rest, splitting the log at both ends respectively by means of a pair of tools (10, 13), one of said pair of tools disposed perpendicularly to said one jaw (6,7), one of said pairs of tools crossing the opposite pair in the median part of the log in the course of each splitting operation, each pair of tools comprising twin tools, each twin tool driven by a control cylinder and being adapted to rotate in the direction of the wood grain independently from the associated twin tool during the splitting operation, returning both of said pairs of tools to their initial rest position, and loosening said jaws in order to release the wood quarters.

2. A method according to claim 1 wherein a cradle (30) is brought into contact with the log during the splitting operation.

3. A method according to claim 1 to produce eight sections from one single log wherein each of said pairs of tools is made to rotate in its diametral plane by means of two driving control cylinders so that the cutting edges (10*a*, 10*b*, 13*a*, 13*b*) will form a 45 degree radial angle with the plane of the jaws disposed at the same end of the log and then initiating a second splitting operation.

4. A method according to claim 3 to produce twelve sections from a single log wherein each of said pairs of tools is made to rotate in its diametral plane by means of two driving control cylinders so that the cutting edges (10*a*, 10*b*, 13*a*, 13*b*) will form a 60 degree radial angle with the plane of the jaws disposed at the same end of the log and then initiating a third splitting operation.

5. A machine for splitting a log along the wood grain with its medullar rays so as to produce quarters and comprising mobile jaws adapted to grip the log (B) by its longitudinal extremities, splitting tools disposed in proximity to said extremities and adapted to split the log into several sections, a rigid support chassis (1), a sliding frame (2,3) mounted on each longitudinal extremity of said support chassis, a double action control cylinder (4,5) for closing and opening each of said sliding frames, each sliding frame bearing a set of two jaws (6,7) held apart from one another on each side of a central support (8,9), said central supports lying in the axis of the frame and thus in the longitudinal axis of the support chassis, one (7) of said sets of jaws being mounted so as to pivot into a vertical plane on one (3) of the sliding frames, the opposite (6) set of jaws mounted so as to pivot into a horizontal plane on the other sliding frame (2), each of said sliding frames bearing a pair of two splitting tools lying in the same plane, and each of said tools being mounted on a control cylinder so as to rotate individually during the splitting operation.

6. A machine according to claim 5 wherein said central support (8,9) of each set (6,7) of jaws is provided with two bars (16,17) pivoted on it at their middles and bearing a long bar (18,19) at each of their extremities, said long bars being hinged on said bars, and said bars and said long bars forming a parallelogram-like mounting.

7. A machine according to claim 5 wherein a tube (22) extends from said supports (8,9), wherein a supporting pin (23) is set into the core at each end of the log, and wherein said supporting pins are adapted to receive said tubes respectively.

8. A machine according to claim 5 wherein said control cylinders (12, 15) are provided respectively with a front (24) and a back (25) support mounting, said mountings being adapted to make a 45 degree rotation in both directions respectively around said central supports (8,9).

9. A machine according to claim 8 wherein each of said support mountings (24,25) is adapted to rotate through an angle of 30 degrees in both directions and be immobilized in each of the resulting positions so as to form a 60 degree angle with the plane of the corresponding set of said jaws (6,7).

10. A machine according to claim 5 wherein a cradle (30) with two rest branches (32,33) is adapted to receive said log and wherein said rest branches are independently controlled respectively by means of two control cylinders (34,35).

11. A machine according to claim 10 wherein said rest branches (32, 33) are provided respectively with elastic pads (36).

* * * * *